United States Patent [19]

Asick

[11] 4,153,325

[45] May 8, 1979

[54] METHOD AND CONNECTOR FOR TERMINATING TWISTED PAIR AND RIBBON CABLE

[75] Inventor: John C. Asick, Harrisburg, Pa.

[73] Assignee: AMP Incorporated, Harrisburg, Pa.

[21] Appl. No.: 879,838

[22] Filed: Feb. 22, 1978

[51] Int. Cl.[2] ..... H01R 13/38

[52] U.S. Cl. ..... 339/99 R; 29/749

[58] Field of Search ..... 339/97 R, 97 P, 98, 339/99 R; 29/747, 749, 748

[56] References Cited

U.S. PATENT DOCUMENTS

| | | | |
|---|---|---|---|
| 3,611,264 | 10/1971 | Ellis, Jr. | 339/99 R |
| 3,820,055 | 6/1974 | Huffnagle et al. | 339/97 P |
| 3,877,771 | 4/1975 | Jensen et al. | 339/99 R |
| 4,025,141 | 5/1977 | Thelissen | 339/99 R |
| 4,062,616 | 12/1977 | Shaffer | 339/99 R |
| 4,084,878 | 4/1978 | Wahi | 339/99 R |

*Primary Examiner*—Joseph H. McGlynn
*Attorney, Agent, or Firm*—Russell J. Egan

[57] ABSTRACT

An improved method and connector are disclosed for terminating twisted pair and ribbon cable. The connector has a base with a plurality of terminals mounted therein with insulation displacing portions extending from one mating surface and a cover with a central slot and a plurality of parallel grooves extending away from each side of the slot on a mating surface. A multi-conductor flat cable is fed through the slot in the cover and the individual conductors are sorted and routed into grooves which assure a proper alignment of the conductors. The conductors are then terminated by application of the base to the cover with the insulation displacing portions of each terminal engaging the appropriate conductor. The conductors can be simultaneously or subsequently sheared along the edges of the connector to form a finished termination.

5 Claims, 5 Drawing Figures

METHOD AND CONNECTOR FOR TERMINATING TWISTED PAIR AND RIBBON CABLE

BACKGROUND OF THE INVENTION

1. The Field of the Invention

The present invention relates to an improved method and connector for terminating twisted pair and ribbon cable and in particular to a termination means and method which reduces the previously required steps of handling during termination.

2. The Prior Art

The previous methods for terminating twisted pair and ribbon cable have required the cable to first be threaded or woven into comb-like portions of a fixture. The thus threaded or laced conductors are then terminated with a known connector and subsequently sheared to a specific length. The terminated cable and conductor is finished by applying a cover to the assembly. Examples of this known connector and method of termination may be found in U.S. Pat. Nos. 4,034,472; 4,036,547; 4,047,785; and 4,048,710.

SUMMARY OF THE INVENTION

The present invention includes a connector having a base member with a plurality of terminals mounted therein, each terminal having an insulation displacing, conductor engaging, slotted portion extending from a first mating surface. The connector also has a cover having a substantially centrally located cable passage slot and a mating face having a plurality of parallel spaced channels extending thereacross from the slot in alignment with respective terminals in the base. The twisted pair or ribbon cable is terminated by passing the cable through the slot in the cover, weaving or lacing the conductors of the cable into the appropriate channels, and terminating the conductors by engaging the cover and the base.

It is therefore an object of the present invention to provide an improved method and connector for terminating twisted pair and ribbon cable which method and connector reduce the previously required steps and handling.

It is a further object of the present invention to produce an improved connector for terminating twisted pair and ribbon cable in which the connector cover itself replaces previously required apparatus for lacing the conductors and holding them into correct alignment during termination.

It is a further object of the present invention to produce an improved connector for terminating twisted pair and ribbon cable which connector can be readily and economically produced.

The means for accomplishing the foregoing objects and other advantages will become apparent to those skilled in the art from the following detailed description taken with reference to the accompanying drawings.

DETAILED DESCRIPTION OF THE PREFERRED EMBODIMENT

Figures 1, 2:
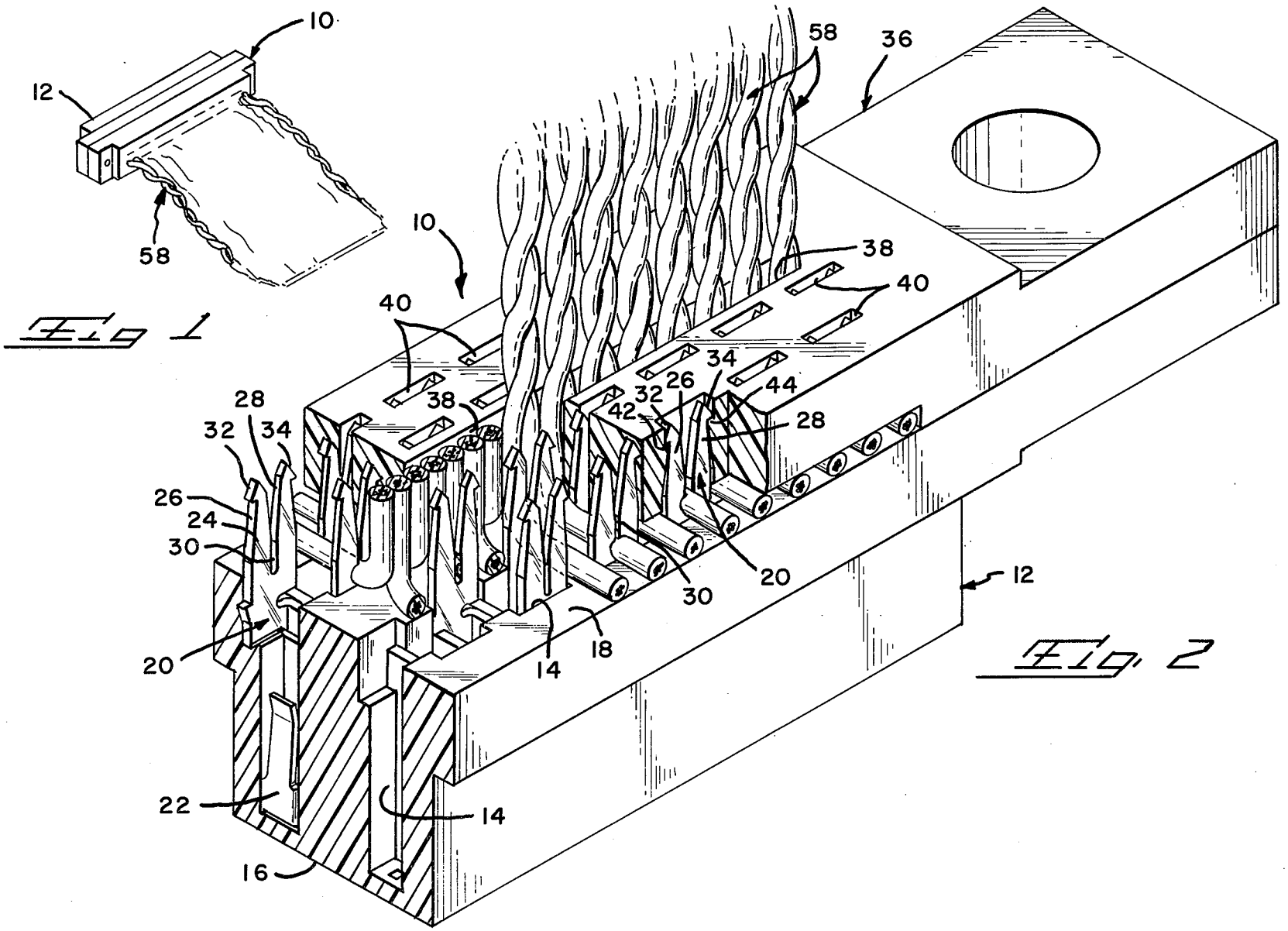
FIG. 1 is a perspective view of a multi-conductor twisted pair cable terminated with a connector according to the present invention.
FIG. 2 is an enlarged perspective view, partially in section, of the subject connector shown terminating the conductors of a multi-conductor twisted pair cable.
Figure 3:
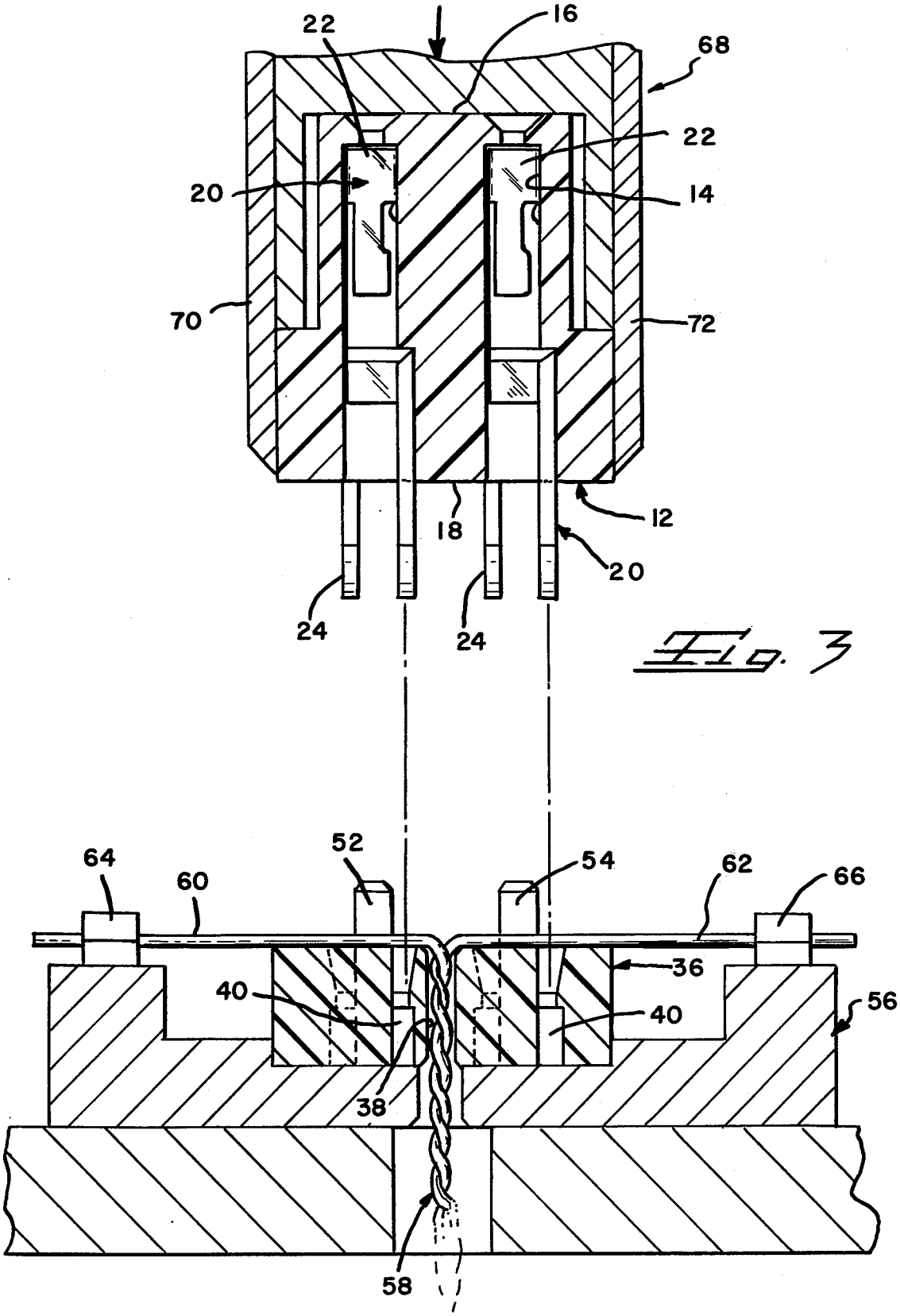
FIG. 3 is an exploded vertical section through the subject connector and an assembly apparatus.

The subject connector 10 includes a base housing 12 having a plurality of parallel spaced contact receiving passages 14 therein extending between a connector mating face 16 and a conductor receiving face 18. Each cavity 14 has mounted therein a respective contact terminal 20 having a first mating end 22 of a configuration suitable for matingly engaging with another terminal (not shown) and a second end 24 formed with a pair of tines 26, 28 defining therebetween an insulation displacing slot 30. Each tine has on its free end an outwardly directed latch 32, 34 respectively. The mating cover 36 includes a centrally disposed cable receiving slot 38 and a plurality of profiled contact receiving slots 40 on each side of slot 38, each contact receiving slot being aligned with a respective contact in said base and including a pair of inwardly directed shoulders 42, 44 which latchingly engage with the respective latches 32, 34 of the terminals 20. The cover also includes a plurality of parallel spaced recesses 46, 48 in its mating face 50, which recesses are formed by a pair of integral, parallel, spaced comb-like projection 52, 54 on normal to and on opposite sides of the central slot 38.

Figure 4:
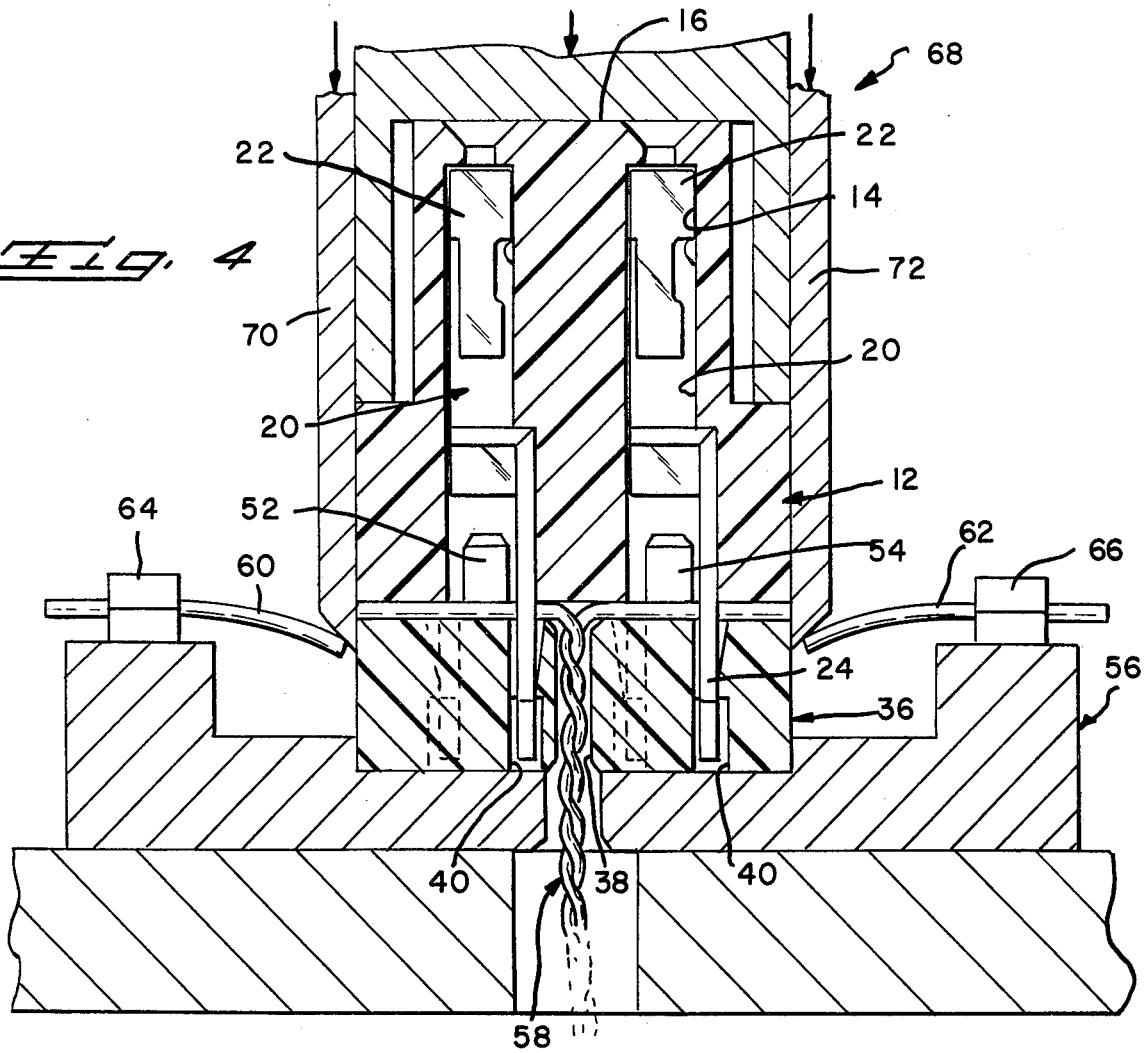
FIG. 4 is a vertical section similar to FIG. 3 showing the subject connector and assembly apparatus after termination of a multi-conductor twisted pair cable.
Figure 5:
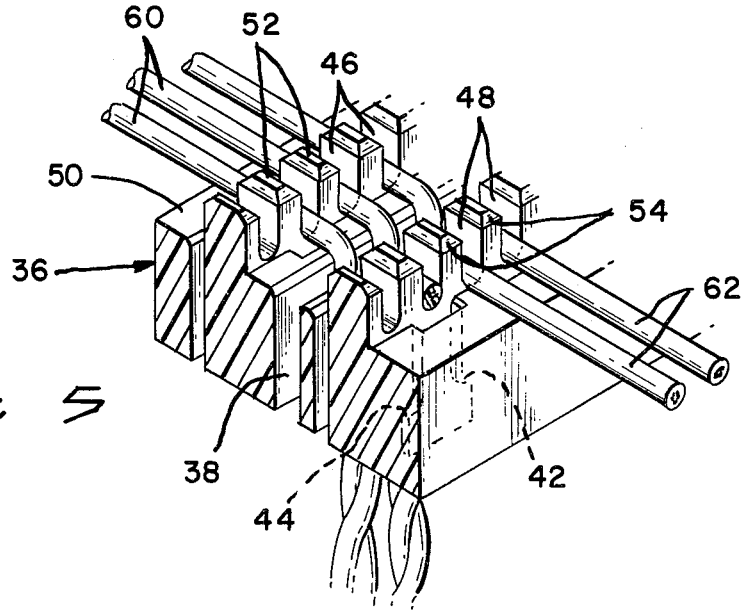
FIG. 5 is a perspective view, partially in section, of a fragment of the cover of the present invention.

The subject connector is applied in the following manner to terminate the conductors of a multiple conductor twisted pair or ribbon cable. The cover 36 is placed in a fixture 56 with mating face 50 up and a cable 58 is fed upwards through the central slot 38. The individual conductors 60, 62 of the cable are threaded through appropriate recesses 46, 48 of the combs 52, 54 and are held in this position in the fixture by wire clamps 64, 66, respectively. The base 12 is positioned in a press assembly 68 with mating face 18 directed downward toward the cover 36. A pair of cut-off blades 70, 72 are included in the press assembly and lie on opposite sides of the base 12. The press is actuated, as shown in FIG. 4, to bring the base down onto the cover to terminate the conductors of the cable in a known manner, as described, for example in U.S. Pat. No. 3,820,055. The slots 30 of the terminals 20 pierce the insulation and engage the conductors 60, 62 and the latches 32, 34 engage the shoulders 42, 44 to secure the cover 36 on the base 12. The cut-off blades 70, 72 shear off the conductors on opposite sides of the terminated connector. The terminated cable is then removed from the press assembly.

The present invention may be subject to many modifications and changes without departing from the spirit or essential characteristics thereof. The present embodiment is therefore to be considered in all respects as illustrative and not restrictive of the scope of the invention.

What is claimed is:

1. A connector for terminating flat multi-conductor twisted pair and/or ribbon cable comprising:

an elongated base member having a plurality of terminal receiving passages therein extending between first and second mating faces, a like plurality of terminals each mounted in a respective passage, each said terminal having an insulation piercing, conductor engaging portion extending beyond said first mating face and a portion profiled to mate with a further terminal and lying at least partially within said passage directed towards said second mating face; and a cover profiled for engagement with said first mating surface and having a centrally disposed elongated slot in a web portion thereof, a plurality of profiled terminal receiving passages opening on a mating face of said cover each said passage being aligned with a respective terminal in said base member, and a plurality of parallel spaced extensions forming a comb-like member on each side of and normal to said elongated slot, whereby a multi-conductor twisted pair or ribbon cable is fed through the slot in a direction normal to the longitudinal axis of the cover, the individual conductors thereof laced into the respective comb-like members and terminated by engagement of the base member with the cover member.

2. A connector according to claim 1 wherein the insulation piercing, conductor engaging portion of each said terminal comprises:

a pair of spaced tines defining an insulation displacing slot therebetween.

3. A connector according to claim 2 further comprising:

an outwardly directed lance on the free end of each said tine, and each said profiled contact receiving passage in said cover having a shoulder engageable by said lances to latchingly secure said cover to said base.

4. A method for terminating ribbon cable and multi-conductor twisted pair cable comprising the steps of:

feeding one end of a flat multi-conductor ribbon or twisted pair cable through a centrally located elongated slot in a base portion of a connector cover, said cable extending at a substantially right angle to the longitudinal axis of the cover;

lacing individual conductors of said cable into recesses in a mating face of said cover, said recesses extending normal to and on opposite sides of said slot; and terminating the cables by applying to said cover a base member having a plurality of terminals mounted therein, each terminal having a conductor engaging portion defined by an insulation displacing slot exposed to engage a respective conductor laced in said cover.

5. An apparatus for terminating multi-conductor twisted pair and/or ribbon cable in connectors having an elongated base member with a plurality of terminal receiving passages therein, a like plurality of terminals each mounted in a respective passage with a first insulation piercing, conductor engaging portion exposed from said passage, and a mating portion lying at least partially within said passage, and a cover having a centrally disposed elongated slot in a web portion thereof, a plurality of terminal receiving passages aligned with the respective terminals in the base member, and a plurality of parallel spaced extensions forming comb-like members on each side of the elongated slot, said apparatus comprising:

a fixture having a base profiled to receive said cover therein with said comb-like members pointing upwards, a cable passing slot aligned with the slot in said cover, and a conductor clamp spaced to either side of said base, and a press assembly disposed above said fixture and including a press profiled on its lower end to receive said base member with said terminals extending downwardly and a cutting blade lying on each side of said base member, whereby a cable is fed upwardly through said fixture and cover slots, the conductors thereof aligned in the respective comb-like members and secured by said clamps, and said base member applied to said cover by said press to effect insulation displacing engagement between the terminals and their respective conductors and the conductors sheared off immediately adjacent the connector.

* * * * *